US005622432A

United States Patent [19]

Zicker

[11] Patent Number: 5,622,432

[45] Date of Patent: Apr. 22, 1997

[54] BAG WITH OPENING TABS

[76] Inventor: William Zicker, 41 A2 Sandra Cir., Westfield, N.J. 07090

[21] Appl. No.: 510,851

[22] Filed: Aug. 3, 1995

[51] Int. Cl.[6] ..... B65D 30/10; B65D 33/22

[52] U.S. Cl. ..... 383/210; 383/211; 383/35; 383/120

[58] Field of Search ..... 383/210, 211, 383/35, 120, 107

[56] References Cited

U.S. PATENT DOCUMENTS

| | | | |
|---|---|---|---|
| 2,189,174 | 2/1940 | Hohl | 383/210 |
| 3,070,225 | 12/1962 | Schwartz | 383/211 X |
| 4,078,717 | 3/1978 | Stearley | 383/35 |
| 4,337,862 | 7/1982 | Suter | 383/211 |
| 5,044,777 | 9/1991 | Watkins et al. | 383/35 X |
| 5,460,839 | 10/1995 | Archibald | 383/120 X |

FOREIGN PATENT DOCUMENTS

| | | | |
|---|---|---|---|
| 1486465 | 6/1969 | Germany | 383/120 |
| 3519688 | 12/1986 | Germany | 383/211 |

*Primary Examiner*—Jes F. Pascua
*Attorney, Agent, or Firm*—Omri M. Behr, Esq.

[57] ABSTRACT

A pair of pleats are formed from the same panel on one side of a cylindrical polyethylene bag in which a film of heat sensitive adhesive layer is on the bag layer to form the necessary heat seals. The bag has a lengthwise seam that is formed as an edge of one of the pleats. The other pleat is folded over material from the one panel. The bag is opened by pulling one of the pleats and an edge of the bag with the other pleat between the two pulling points. The pulling forces separate the layers of the one pleat permitting easy access to the bag which is sealed at both ends. The pleats are preferably sealed along the bag length end to end and share a common junction with the one panel from which they are formed.

17 Claims, 3 Drawing Sheets

BAG WITH OPENING TABS

This invention relates to bags, in particular, food or article container bags such as cereals and the like, formed of heat sealed thermoplastic or other films and including opening tabs.

Thermoplastic film bags are in wide use. These bags are heat sealed at opposite ends. The bags are widely used for cereals, candies or other edibles and numerous other goods and articles. The bags typically are hermetically sealed and retain the freshness of the goods. The problem experienced with these bags is ease of opening by consumers. Usually such bags are made of tough material not easily torn or ripped by hand. Often, such bags are fabricated with small cuts at an edge thereof to facilitate opening by hand.

The art has developed different solutions to this problem. For example, U.S. Pat. No. 2,189,174 to Hohl discloses a container with a pair of opposed panels bonded together at one end to form a seal. A pair of finger tabs or pleats are connected to the panels on opposite sides of the container in opposed relation such that finger gripping the tabs and pulling them apart opens the seal.

U.S. Pat. No. 3,216,646 discloses a side printed easy opening polyolefin bag. Disclosed are creases on opposite sides of the bag to facilitate opening the bag. U.S. Pat. No. 4,078,717 also discloses a bag with opening means comprising opposing creases. In U.S. Pat. No. 4,892,744 a popcorn bag is disclosed with a convenient means to open the bag.

The present inventor recognizes that while the above patents disclose means for providing easy opening of the bags, it is recognized that a need is seen for an opening device that uses less material than the prior art which effects cost savings due to the high volume of these bags. Also, ease of manufacturing such bags is also desired.

According to one embodiment of the present invention, a pliable container comprising opposing panels forms opposing container sides. The container has opposing ends and the panels are bonded at at least one of the ends to form a seal. A pair of pleats is formed from one of the panels and is located at the seal at the at least one end on one side of the container.

According to a further embodiment, a container according to the present invention comprises a cylindrical member having opposing flexible panels bonded together at at least one end to form a seal, the member having opposing edges each extending in a direction transverse the seal and a pair of finger gripping tabs in adjacent relationship on one of the panels between the edges at the at least one end, the tabs and opposing edges being arranged such that gripping one of the tabs and one of the opposing edges with the other of the tabs therebetween and pulling the tabs apart breaks the seal and opens the at least one end.

According to a further embodiment, the cylindrical member comprises thermoplastic film having opposing broad surfaces, suitably but not critically, with a heat sensitive adhesive layer on one of the surfaces.

In a still further embodiment, the cylindrical member is formed of a sheet layer material wherein the tabs each comprise a pleat formed from two overlying layers of the material integral with and one piece with the one panel and bonded together.

In a further embodiment, the container has a length defined by opposing ends, the pleats extending for the length of the container to the opposing ends.

According to the invention, the container has a length defined by opposing ends, the cylindrical member being formed of a sheet material with a seam extending to the opposing ends, each of the overlying layers of one of the pleats comprising a layer terminating in the seam such that the seam is at the edge of the one pleat.

IN THE DRAWING

Figure 1:
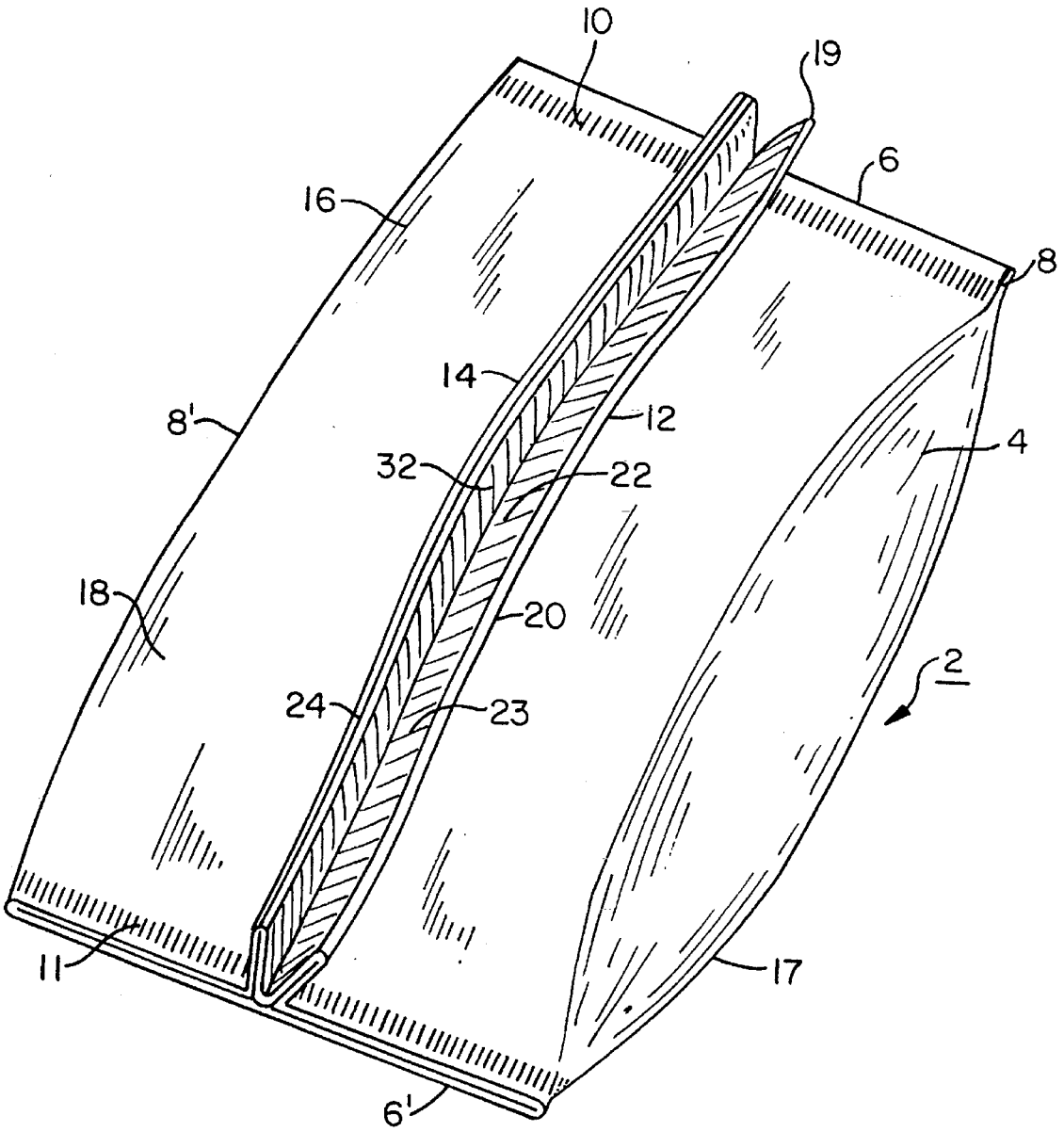
FIG. 1 is an isometric view of a sealed filled bag according to an embodiment of the present invention.

In FIG. 1, bag 2 comprises a preferably polyethylene sheet material 4 with a heat sensitive inner layer (not shown). This is a pliable material and is easily shaped as desired. While polyethylene is preferred the bag may comprise any other known film or sheet materials used to construct hermetically sealed bags for food stuff or other articles. Such materials are disclosed by way of example in U.S. Pat. No. 2,189,174 incorporated by reference herein. Such other materials may also include coated metal foils including thermoplastic and or adhesive coatings. While a heat sensitive coating material is preferred, a separate adhesive may be applied according to a given implementation and bag material employed.

Bag 2 has opposing ends 6, 6' and opposing side edges 8, 8'. The sheet material 4 comprises an outer layer of the polyethylene layer and an inner layer of heat sensitive adhesive, forming a laminated material. A heat seal 10 and 11 is formed at each respective end 6, 6' from edge 8 to opposite edge 8'.

Figure 2:
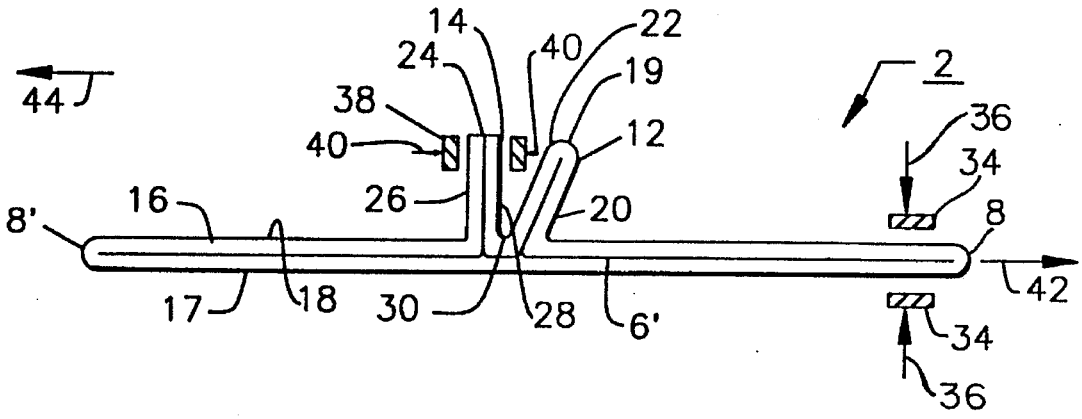
FIG. 2 is a plan view of an edge of the bag of FIG. 1.

A pair of pleats 12 and 14 are formed from the material 4 on one panel 16 on one side 18 of the bag 2. The other opposite panel 17 has no such pleats. In FIG. 2, the bag 2 when initially formed is flat as shown and only one end 6 seal 10 is formed. The other end 6' is open and seal 11 not yet formed so the bag 2 may receive goods or articles (not shown). The open end, e.g., end 6', may be the bottom of the bag when inserted into an outer container such as a carton as used for cereals, for example.

In FIG. 2, the pleat 12 is formed from the material 4 on side 18 and comprises two layers 20 and 22 in juxtaposed relation folded over upon each other at fold 19. The pleat 12 extends for the length of the bag 2 from end 6 to end 6'. The pleat 12 layers 20 and 22 are heat sealed together by applying heat and pressure to the opposite layers 20 and 22 as shown by heat seal 23, FIG. 1. The heat melts the adhesive layer and the pressure insures that the two layers are bonded. The heat sealing is performed in a known manner. Preferably, the pleat 12 is centrally between the edges 8 and 8' with the seal 23 extending the length of the bag 2.

Pleat 14 includes a seam 24 at the pleat edge. The seam 24 extends for the length of the bag 2, FIG. 1. Pleat 14 comprises the two edge regions 26 and 28 of the sheet material forming the seam 24. The edge regions 26 and 28 once bonded by seam 24 form an integral structure that is part of the panel 16 on the side 18 of the bag 2. Pleats 12 and 14 have about the same width from their edges, such as fold 19, pleat 12 and seam 24, pleat 14, to root 30. The pleats 12 and 14 preferably have a common channel and root 30 and thus are next adjacent to each other. Pleat 14, FIG. 1, is sealed with a seal 32 for the length of the pleat 14.

To open the bag once it is sealed at both ends as illustrated in FIG. 1, one bag edge such as edge 8, FIG. 2, is gripped by finger grasping with one hand at shaded rectangles 34 in the direction of the arrows 36. The pleat 14 is gripped as represented by rectangles 36 in directions 40. The pleat 12 is between these two gripped locations. The edge 8 and the pleat 14 are then pulled apart in directions 42 and 44, respectively.

Figure 3:
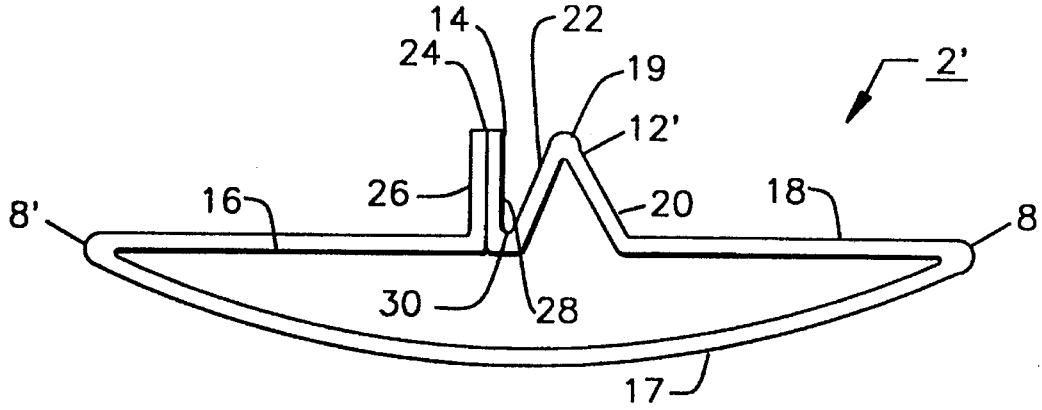
FIG. 3 is a plan view of the edge of the bag of FIG. 2 after opening in accordance with one embodiment.

This pulling action then opens up the seal on pleat 12 as shown by pleat 12' FIG. 3, bag 2'. The user can then insert a finger into this opening to break the seal 10 further by pulling the panels 16 and 17 apart at that end such as end 6'.

Figure 4:
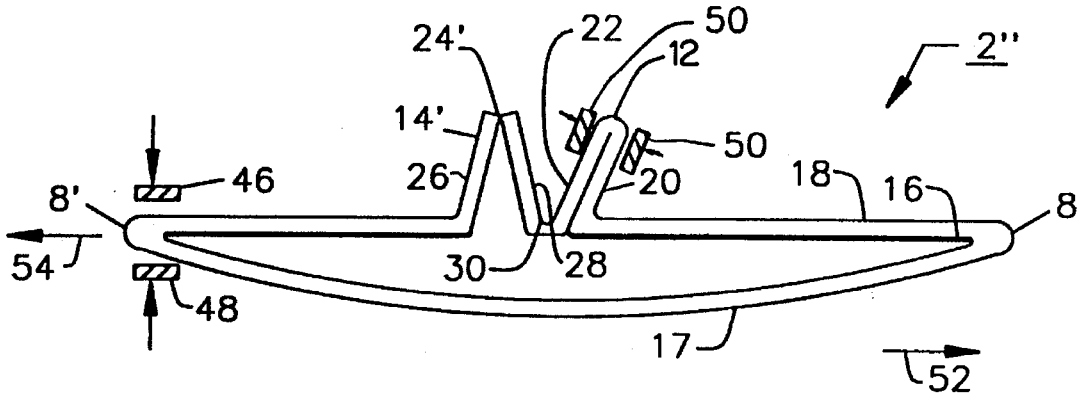
FIG. 4 is a plan view of the edge of the bag of FIG. 2 after opening in accordance with a second embodiment.

In the alternative, in FIG. 4, bag 2" can be opened by grasping edge 8' at the regions shown by rectangles 46 and 48 and grasping pleat 12 at regions 50 as shown by the arrows coupled thereto. Pleat 12 is then pulled in direction 52 and edge 8' is pulled in the opposite direction 54. This action pulls the pleat 14' apart opening its seal 32. Once opened the user can insert a finger int the opening formed by the broken seal and open the corresponding seal 11 or 10 as the case may be. The pulling forces always open that pleat which is intermediate the edge and other pleat being pulled. It does not matter which pleat is being pulled or which pleat is in the intermediate region. While the pleats are shown spaced closely they may be spaced further apart as it is the pulling forces that open the seal, the forces being present regardless the spacing of the pleats.

The pleats thus serve as finger gripping tabs which are dimensioned sufficiently to be grasped to exert the necessary forces. While the seam 24 is at the edge of the pleat 14, this is by way of example. The seam 24 may be at other locations if desired. By placing the seam at the pleat the forces are local to both the pleat and the seam minimizes opening the seam further than desired. If the seam is spaced from the pleats, then the seam might be opened to an extent that its not desired. That is, it is desired to open the end of the bag but not the seam along the side of the bag for any excessive length.

The pleats 12 and 14 use less material than the four tab arrangements of the prior art and yet permit easy opening of the bag.

Figure 5:
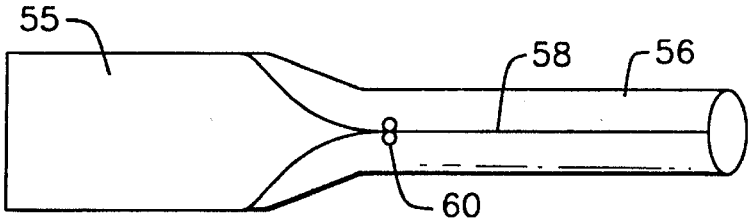
FIGS. 5–9 show various stages of manufacturing the bag of FIG. 1.
Figure 6:
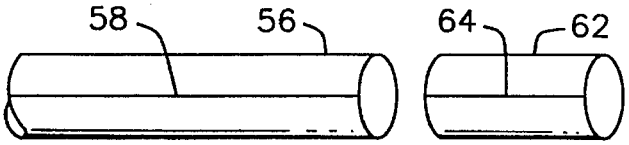
Figure 7:
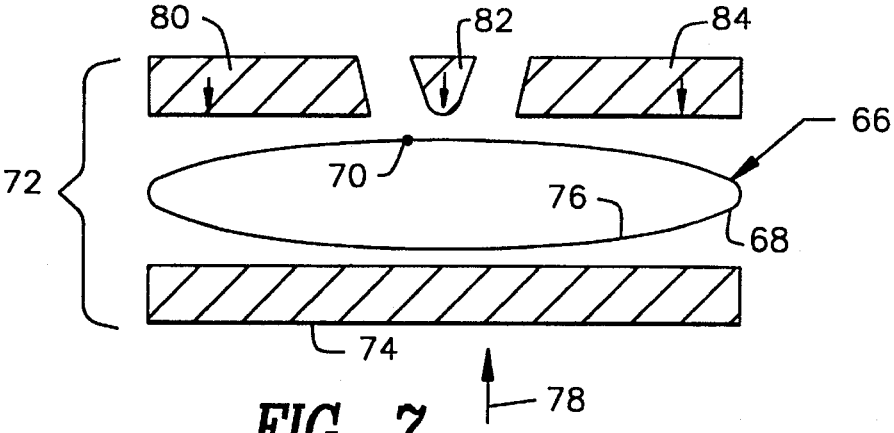
Figure 9:
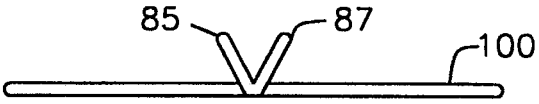

In FIG. 5 a flat sheet of pliable film 55 with an adhesive heat sensitive layer is formed into a cylinder 56. Seam 58 is formed by pressure and heat applying rollers 60. The cylinder 56 is then cut into a plurality of short length cylinders 62, FIG. 6, each having a seam 64. In FIG. 7 a cylinder 66 of sheet material 68 with seam 70 is placed in a pleat forming apparatus 72. Apparatus 72 comprises a die 74 which engages lower panel 76 of the cylinder 66 in direction 78. On the opposite side of the cylinder 66 a set of dies 80, 82 and 84 are displaced toward die 74 to compress the cylinder 66 in the direction of the arrows shown. Die 82 is wedge shaped and serves to form with the dies 80 and 82 the desired pleats 85 and 87, FIG. 9. The dies 80, 82 and 84 also apply heat and pressure to form the seals which form the pleats 85 and 87.

Figure 8:
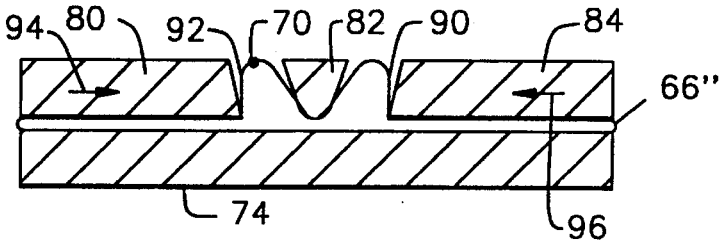

In FIG. 8, the cylinder 66' is compressed by the dies 74 and 80, 82 and 84 as shown. Except for the bulbulous pleat regions 90 and 92 forming pleats 85 and 87, the remainder of the cylinder 66" is flat. The dies 80 and 84 are then displaced toward each other to squeeze the bulbulous regions 90 and 92, respectively, in the direction of the arrows 94 and 96 toward die 82 forming the respective pleats 85 and 87 of bag 100, FIG. 9.

It should be understood that the above description is by way of example, and that other bag constructions and fabrication techniques may be used to fabricate a bag according to the present invention. It is intended that the invention be defined by the appended claims.

What is claimed is:

1. A container comprising:

a cylindrical member having opposing juxtaposed flexible panels of substantially the same dimensions, the panels being bonded together at at least one end to form a seal, said member having opposing edges each extending in a direction transverse the seal; and a pair of finger gripping tabs in adjacent relationship on one of said panels between said edges at said at least one end, said tabs and opposing member edges each being arranged for finger gripping by a pair of corresponding fingers such that a force applied by pulling in opposing directions one of said tabs and one of said opposing edges with the other of said tabs therebetween breaks the seal and opens the at least one end wherein said tabs are in sufficiently closely spaced position on the one panel side such that the tabs form an approximate V-shaped channel therebetween forming a root wherein a side of each tab is joined at the root.

2. The container of claim 1 wherein the cylindrical member is formed of a sheet layer material wherein said tabs each comprise a pleat formed from two overlying layers of said material integral with and one piece with the one panel and bonded together.

3. The container of claim 2 wherein the container has a length defined by opposing ends, said pleats extending for the length of the container to said opposing ends.

4. The container of claim 2 wherein the container has a length defined by opposing ends, each pleat having an edge extending along said length, the cylindrical member being formed of a sheet material with a seam extending to said opposing ends, each of said overlying layers of one of said pleats comprising a layer terminating in said seam such that the seam is at the edge of said one pleat.

5. The container of claim 1 wherein the container is formed of pliable sheet material forming at least one layer, the tabs each comprise overlying bonded portions of said at least one layer.

6. The container of claim 1 wherein said cylindrical member comprises polyethylene film with a heat sensitive adhesive layer.

7. A container comprising:

a member formed of pliable film material with a heat sensitive adhesive layer for bonding the material to itself, said member comprising opposing flexible panels having opposing edges and of approximately the same dimensions bonded together in juxtaposed relation at at least one end to form a seal at the one end, said member having opposing edges each formed by an edge of each said panels, each edge extending in a direction transverse the seal; and a pair of finger gripping pleats in adjacent relationship on and formed from one of said panels between said member edges at said at least one end, said pleats each comprising two juxtaposed layers of said material, said finger gripping pleats, wherein said pleats are in sufficiently closely spaced position on the one panel side such that the pleats form an approximate V-shaped channel therebetween forming a root wherein a side of each pleat is joined at the root.

8. The container of claim 7 wherein said two juxtaposed layers are bonded by said heat sensitive layer.

9. The container of claim 7 wherein said cylindrical member has opposing ends, said pleats extending to and between said opposing ends.

10. The container of claim 9 including a seal at said opposing ends and extending to and between said edges.

11. A pliable container comprising opposing panels of substantially the same dimensions forming opposing container sides, the container having opposing ends and a pair of opposing edges formed by said panels, said panels being bonded at at least one of said ends to form a seal, and a pair of pleats formed from one of said panels and located at said seal at the at least one end on one side of the container, said pleats and container edges each being constructed for gripping by a pair of corresponding fingers for manually pulling on said pleats and container edges, wherein said pleats are in sufficiently closely spaced position on the one panel side such that the pleats form an approximate V-shaped channel therebetween forming a root wherein a side of each pleat is joined at the root.

12. The container of claim 11 wherein the container has a longitudinally extending seam between and to said opposing ends, one of said pleats including said seam.

13. The container of claim 12 wherein the container comprises sheet material having opposing edges forming said seam, each of said pleats being formed of opposing layers of said sheet material, each pleat having an edge, said seam being located at the edge of one of said pleats.

14. The container of claim 11 wherein said pleats extend to each said opposing ends.

15. A container of pliable material having opposing ends and opposing edges, the container being normally flat prior to filling and including a pair of opposed panels of approximately the same dimensions and having a heat sensitive layer for sealing the panels together, and a pair of adjacent flanges upstanding from and formed from one of said panels between said edges, said flanges and said container edges each being arranged for being gripped by a pair of corresponding fingers wherein said flanges are in sufficiently closely spaced position on the one panel side such that the flanges form an approximate V-shaped channel therebetween forming a root wherein a side of each flange is joined at the root.

16. The container of claim 15 wherein one of said flanges includes a seam of said container joining said panels together to and between said edges.

17. The container of claim 15 wherein said material comprises polyethylene film with a heat sensitive adhesive layer.

* * * * *